US012484728B2

(12) United States Patent
Sawyer

(10) Patent No.: US 12,484,728 B2
(45) Date of Patent: Dec. 2, 2025

(54) WETSUIT WRENCH

(71) Applicant: 1368576 B.C. LTD, Victoria (CA)

(72) Inventor: Kyle Sawyer, Victoria (CA)

( * ) Notice: Subject to any disclaimer, the term of this patent is extended or adjusted under 35 U.S.C. 154(b) by 0 days.

(21) Appl. No.: 18/866,204

(22) PCT Filed: Jun. 7, 2023

(86) PCT No.: PCT/CA2023/050781
§ 371 (c)(1),
(2) Date: Nov. 15, 2024

(87) PCT Pub. No.: WO2023/235972
PCT Pub. Date: Dec. 14, 2023

(65) Prior Publication Data

US 2025/0318673 A1 Oct. 16, 2025

Related U.S. Application Data

(60) Provisional application No. 63/350,283, filed on Jun. 8, 2022.

(51) Int. Cl.
*A47G 25/90* (2006.01)
*B63C 11/04* (2006.01)

(52) U.S. Cl.
CPC ..... *A47G 25/90* (2013.01); *B63C 2011/046* (2013.01)

(58) Field of Classification Search
CPC .... A47G 25/90; A47G 25/905; A47G 25/907; A47G 25/908; A47G 25/92; B63C 2011/046
See application file for complete search history.

(56) References Cited

U.S. PATENT DOCUMENTS 255,552 A * 3/1882 Webster ..... A41F 19/005 24/15
1,334,976 A * 3/1920 Tipping ..... A47G 25/90 223/111
1,810,363 A * 6/1931 Malapeta ..... A47G 25/90 223/111
2,939,618 A 6/1960 Mangels
(Continued)

FOREIGN PATENT DOCUMENTS

CN 110934475 A * 3/2020 ..... A47G 25/90
GB 2539481 12/2016
(Continued)

OTHER PUBLICATIONS

Translation CN 110934475.*

*Primary Examiner* — Shaun R Hurley
(74) *Attorney, Agent, or Firm* — Damien G. Loveland; Valuetech Patent Agency Inc.

(57) ABSTRACT

Wetsuits and booties are known to be difficult to remove. Here, a wetsuit removal tool has a hook attached to a flexible strap. The hook is hooked over an edge of a wetsuit to the side of the neck. The strap is stepped on while the user is crouched down. As the user stands up, tension develops in the strap and partly pulls the wetsuit off. The hook can be hooked over a top edge of a bootie and the strap looped around the user's other foot. The user extends the leg with the looped strap while flexing the leg with the hooked bootie, causing the strap to develop tension and pull off the bootie. The hook may be adjustable.

20 Claims, 5 Drawing Sheets

(56) References Cited

U.S. PATENT DOCUMENTS

| | | | | | |
|---|---|---|---|---|---|
| 3,310,209 | A * | 3/1967 | Clauss | A47G 25/905 | 223/111 |
| 3,452,907 | A * | 7/1969 | Maclauchlan | A47G 25/905 | 223/111 |
| 4,651,909 | A * | 3/1987 | Banting | A47G 25/905 | 223/111 |
| 5,598,956 | A * | 2/1997 | Schenberg | B60R 7/10 | 224/313 |
| D401,759 | S * | 12/1998 | Marguerie | D3/18 | |
| 6,283,342 | B1 * | 9/2001 | Wilkerson | A47G 25/905 | 223/111 |
| D654,639 | S * | 2/2012 | Huber | D30/153 | |
| 8,109,418 | B1 | 2/2012 | Recchia | | |
| D694,096 | S * | 11/2013 | DeFrancisci | D8/367 | |
| 10,016,082 | B1 * | 7/2018 | Merker | A47G 25/90 | |
| 10,390,646 | B1 | 8/2019 | Cox | | |
| D885,873 | S * | 6/2020 | Deng | D8/367 | |
| D891,236 | S * | 7/2020 | Kaufman | D8/382 | |
| D899,234 | S * | 10/2020 | Chen | D8/367 | |
| D931,089 | S * | 9/2021 | Guo | D8/367 | |
| D964,845 | S * | 9/2022 | Chen | D8/367 | |
| D965,503 | S * | 10/2022 | Yao | D12/416 | |
| D986,716 | S * | 5/2023 | Yao | D8/367 | |
| D1,034,169 | S * | 7/2024 | Liu | D8/367 | |
| 2002/0139819 | A1 | 10/2002 | Ferraioli | | |
| 2008/0217365 | A1 | 9/2008 | Fox | | |
| 2008/0290121 | A1 | 11/2008 | Wise et al. | | |
| 2010/0258600 | A1 * | 10/2010 | Pfistor | A47G 25/90 | 223/111 |
| 2012/0272534 | A1 | 11/2012 | Lee | | |
| 2014/0151412 | A1 * | 6/2014 | Cohen | A47G 25/905 | 223/111 |
| 2015/0083761 | A1 | 3/2015 | Clifton | | |
| 2015/0245725 | A1 * | 9/2015 | Benjamin | A47G 25/92 | 24/40 |
| 2016/0213184 | A1 * | 7/2016 | Kobyluck | A47G 25/90 | |
| 2019/0261800 | A1 | 8/2019 | Taylor | | |
| 2020/0138188 | A1 * | 5/2020 | Dudley | A47G 25/10 | |

FOREIGN PATENT DOCUMENTS

| | | | | |
|---|---|---|---|---|
| WO | 2014114799 | | 7/2014 | |
| WO | WO-2014114799 | A1 * | 7/2014 | A47G 25/90 |

* cited by examiner

WETSUIT WRENCH

TECHNICAL FIELD

This application relates to wetsuit accessories. More specifically, it relates to a tool for facilitating the removal, by the user, of a wetsuit and booties.

BACKGROUND

The movement of getting out of a wet wetsuit has plagued water sports for years. People may get more injuries when they are trying get out of their wetsuit than when they are participating in the water sport itself. People will usually struggle with removing a wetsuit by themselves rather than ask for help from a stranger, which may result in falling over.

The biggest hurdle for users is to get the wetsuit off from over their shoulders. When doing so, when removing the first shoulder from the wetsuit, the user must bend their opposite shoulder awkwardly and forcefully in order to remove the wetsuit. This may result in injury to the user's shoulder and/or back.

Some existing devices have a design of a "shoehorn" type of lever. However these types of device are still awkward to use when reaching the opposite shoulder across the user's body, and may still result in shoulder or back injuries.

Patent application PCT/EP2014/051545 to Taylor discloses a wetsuit removal tool. It has rounded tips that help guide rollers into heel position while fins work in harmony to push the wetsuit off the user's legs. It is also a hanger that the wetsuit can be hung on after use.

This background is not intended, nor should be construed, to constitute prior art against the present invention.

SUMMARY OF INVENTION

The present invention is directed to a wetsuit wrench designed to assist a person in removing a wetsuit and wetsuit accessories such as gloves and wetsuit boots. To remove a wetsuit, the wetsuit wrench has a hook with a relatively long tail or strap that is designed to be stood on while the user is initially slightly bent over. As the user stands up, the hook pulls down on the wetsuit and therefore facilitates its removal. The wetsuit wrench can also be hooked over the rim of a bootie, with the user's other foot in a loop made by the strap. As the leg with the bootie is flexed and the leg with the looped strap is extended, the bootie is pulled off. The hook may be adjustable.

Disclosed herein is a wetsuit wrench comprising: a hook having a body that is connected at a head end thereof via a bend to a head, wherein the body is plate-like and the head is plate-like; and a strap attached at one end thereof to a lower region of the body distal from the head end; wherein: the head narrows to terminate in a curved nose; an edge of the head is radiused; and both an inner surface and an outer surface of the head are smooth.

This summary provides a simplified, non-exhaustive introduction to some aspects of the invention, without delineating the scope of the invention.

BRIEF DESCRIPTION OF DRAWINGS

The following drawings illustrate embodiments of the invention, which should not be construed as restricting the scope of the invention in any way.

DESCRIPTION

A. Exemplary Embodiments

Figure 1:
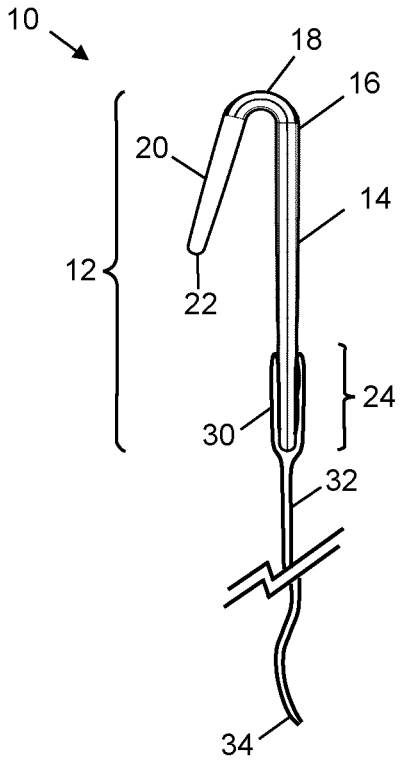
FIG. 1 is a schematic drawing of a wetsuit wrench seen from the side, according to an embodiment of the present invention.

Referring to FIG. 1, there is shown a wetsuit wrench 10 with a hook 12. The hook has a body 14 connected at its upper end 16 to a bend 18, which is in turn connected to a head 20 that terminates in a nose 22. The lower region 24 of the body 14 or hook 12 is connected to one end 30 of a tail or strap 32. The other end 34 of the strap may be free, or connected to a tool or device such as a carabiner.

Figure 2:
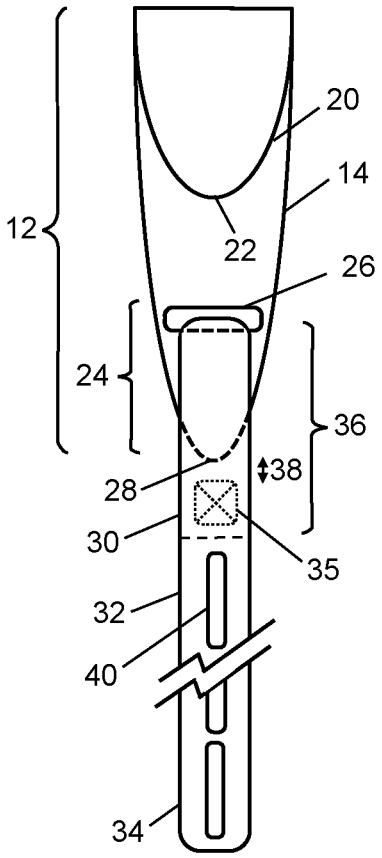
FIG. 2 is a schematic drawing of a wetsuit wrench seen from the front, according to an embodiment of the present invention.

Referring to FIG. 2, the hook 12 is seen to have a head 20 that is plate-like with a curved periphery, such that the head may be described as gradually narrowing across its width to terminate in a curved nose 22. The body 14 is also seen to be plate-like in form. Herein, the term "plate-like" is used to describe a shape that extends significantly more in both directions of its area than in its thickness, for example like a panel that may be flat or curved.

The hook 12 has in its bottom section or lower region 24 a slot 26 where the strap 32 is inserted and connected to the hook. In some embodiments, an area of stitching 35 connects the end 30 of the strap back on itself, thus forming a loop 36 that goes through the hole or slot 26 in the lower region 24 of the body of the hook. In some embodiments, the strap is attached to the hook via a clip or Velcro® hook-and-loop fastener. The location of the stitching 35 allows for a gap 38 between the joined portions of the strap and the end 28 of the hook. This gap 38 allows for the strap 32 to be swung to either side in order to reveal the lower region 24 of the hook 12, which would normally be covered by the strap. Access to the lower region 24 of the hook 12 may be desirable to access a tool, for example, which is located in, on or as part of the lower region of the hook.

The strap 32 has one or more elongated holes 40, through which the end 34 of the strap may be passed and tied, or attached with a clip, toggle or other fastening device. In some cases the end 34 of the strap 32 may be fed through a single hole multiple times, or woven in and out of multiple holes. A larger loop can therefore be formed by the free end of the strap, the loop being large enough to fit a foot of a user, for example. In some embodiments, the holes 40 are large enough to feed the hook 12 through to form the larger loop.

Figure 3:
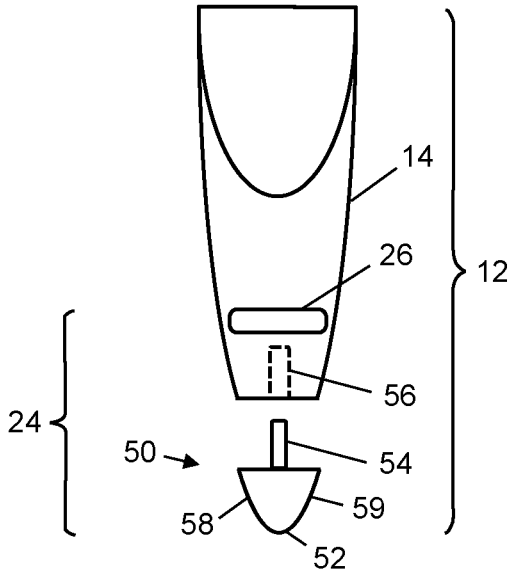
FIG. 3 is a schematic drawing of the hook of a wetsuit wrench with a removable fin key, according to an embodiment of the present invention.

Referring to FIG. 3, there is shown the hook 12 of the wetsuit wrench. The hook has a detachable fin key 50 stored as part of the lower region 24 of the body 14 of the hook. The connection between the fin key and the hook is separable in order for the user to be able to use the fin key when needed. The loop of the strap through the slot 26 in the hook 12 is slack enough so that the strap can be moved to one side or the other in order to provide access to the fin key.

The fin key 50 has a flat handle 52 and a hexagonal wrench 54, dimensioned for stud screws that fasten the fins to a surfboard (e.g. a 2 mm hexagonal wrench). The hexagonal wrench 54 fits into a hole 56 in the lower region 24 of the hook 12, below the slot 26. The fin-key may be plugged or screwed into the lower region of the hook.

In some embodiments, the attachment is a removable clip in order for the user to be able to remove the fin key and replace it into the body of the hook. One edge 58 of the fin key 50 may be an edge for scraping wax off a surfboard. Another edge 59 of the fin key 50 may be a comb for roughening or scoring the surface of the wax on a surfboard. In some embodiments, the hexagonal wrench may be removable from the handle of the fin key, so that another, differently sized hexagonal wrench may be inserted into the handle. One or more spare or differently sized hexagonal wrenches may be stored in cavities in the remainder of the body of the hook, which are exposed when the fin key is detached from the body of the hook.

Figure 4:
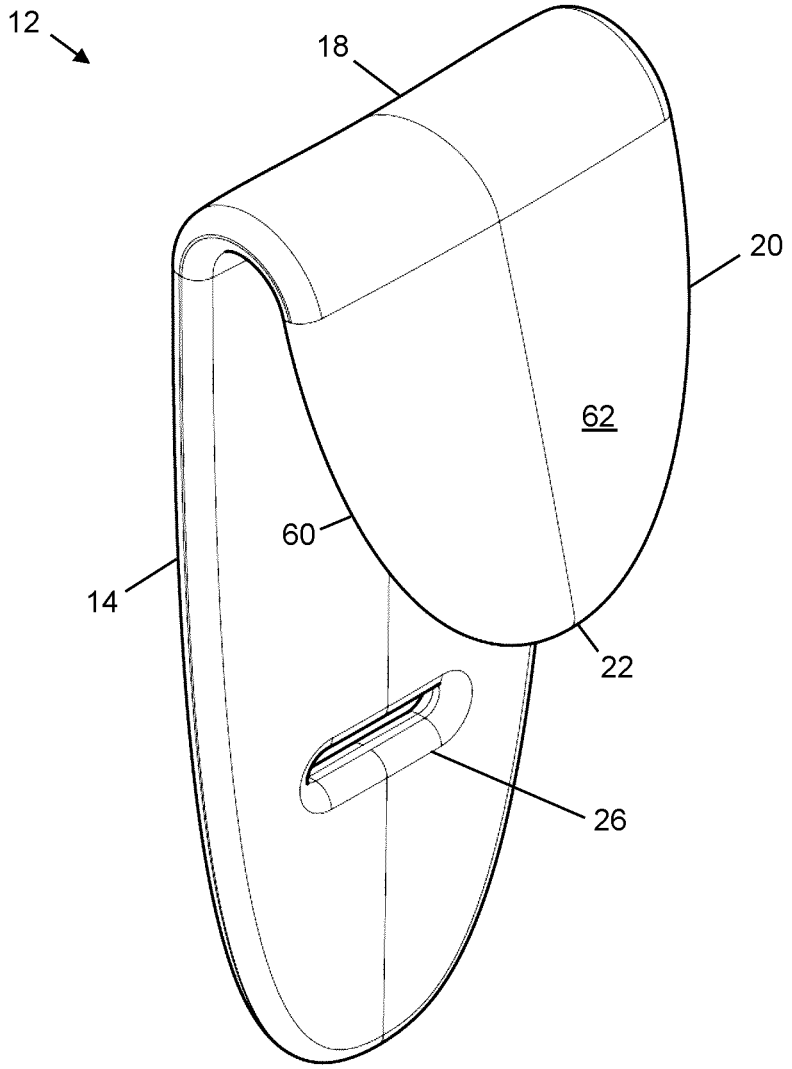
FIG. 4 is a perspective view of a hook of a wetsuit wrench, according to an embodiment of the present invention.

Referring to FIG. 4, the hook 12 is shown, with the plate-like body 14 and the plate-like head 20, connected to each other via the bend 18. The slot 26 is shown in the lower region of the hook. The curvature of the sides of the head 20 is shown, the head terminating in a curved nose 22. The curvature of the head and nose allows the head of the hook to be more easily and comfortably inserted between the wet wetsuit and the skin of the user, compared to a flat-ended or sharp-pointed nose, for example. The edge or edges 60 of the head are radiused so that sharp edges are not present on the head, which may scratch or damage the user's skin, or damage the wetsuit. The edge 60 may be a single radius connecting outer and inner surfaces of the head. In other cases, the outer and inner edges of the head may each be radiused with a small side therebetween, which is perpendicular, for example, to the outer and inner surfaces of the head.

The outer surface 62 of the head is smooth, to allow the head of the hook to be more easily and comfortably inserted between the wet wetsuit and the skin of the user, compared to a head with a rougher, uneven or profiled surface. Likewise, the inner surface (64, FIG. 6) of the head, facing inwards towards the body 14, is also smooth. The smooth surfaces of the head may provide a relatively low friction for sliding the head of the hook between the skin of the user and the wet wetsuit. In some embodiments, a non-stick or low-friction material such as PTFE (polytetrafluoroethylene) may be coated on the head. In other embodiments, the whole of the hook may be made from a low-friction material.

Figure 5:
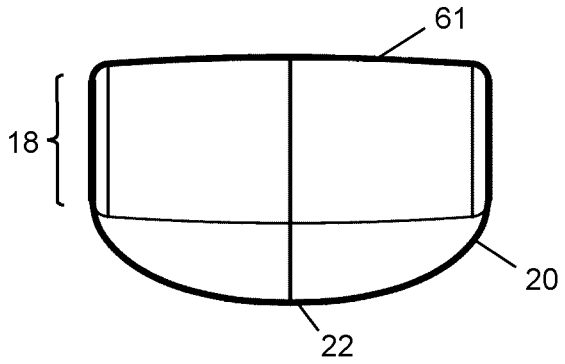
FIG. 5 is a top view of a hook, according to an embodiment of the present invention.

FIG. 5 shows the top view of the hook 12, showing the bend 18 and the head 20 that terminates in the nose 22. The rear surface 61 of the body 14 of the hook is slightly convex. In other embodiments, the rear surface 61 is flat, or more convex than shown here.

Figure 6:
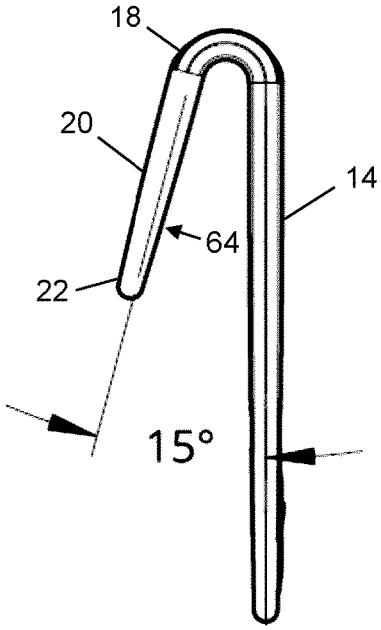
FIG. 6 is a drawing of a hook of a wetsuit wrench seen from the side, according to an embodiment of the present invention.

FIG. 6 shows that the body 14 of the hook is connected to the head 20 of the hook at an angle of 15°. In other embodiments, this angle may be different. For example, the angle may be between 10-20° or even outside this range. Also shown is the tapering of the thickness of the head 20 from a greater thickness at the bend 18 to a narrower thickness at the nose 22. This tapering helps the user to initially insert the nose of the head between the wet wetsuit and the user's skin, while providing strength and rigidity in the remainder of the head, bend and body of the hook.

Figure 7:
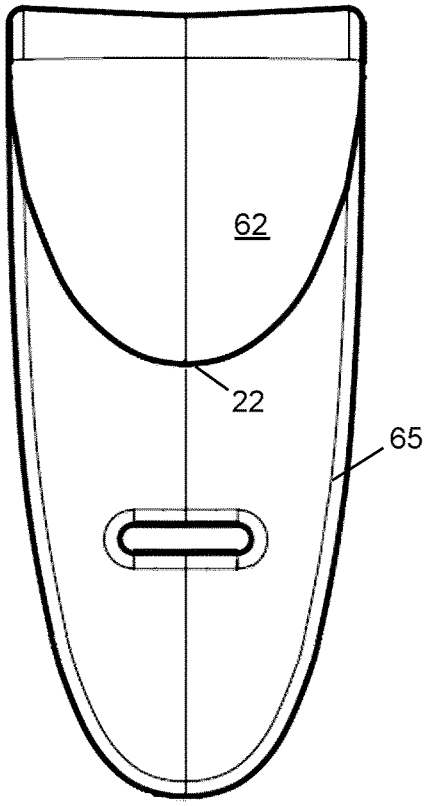
FIG. 7 is a drawing of the hook of a wetsuit wrench seen from the front, according to an embodiment of the present invention.

FIG. 7 shows the front of the hook, showing the contour line 65 that indicates the start of the radius of the edge of the hook. In general, all edges of the hook are smooth or radiused so that minimal damage is caused to a user's skin or to the wetsuit or booties.

Figure 8:
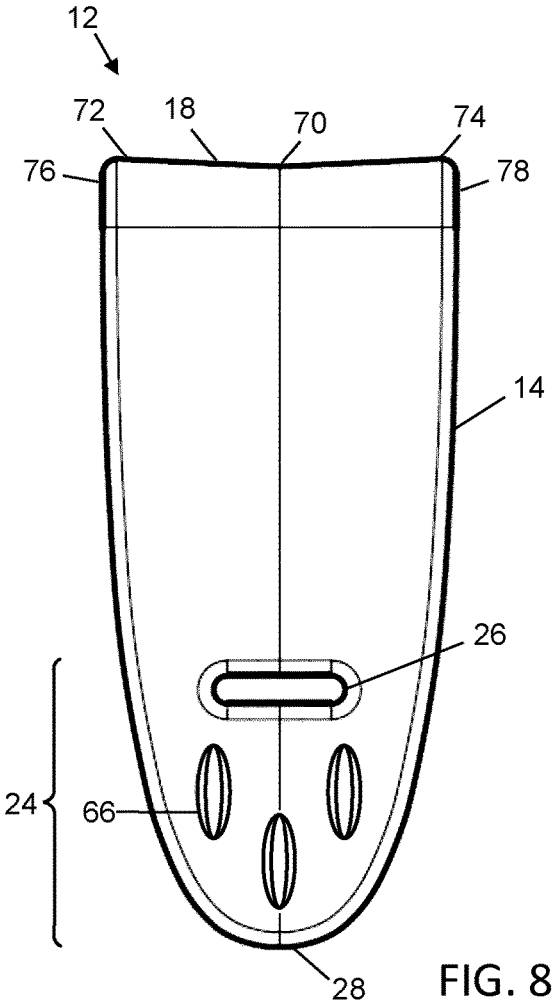
FIG. 8 is a drawing of the hook of a wetsuit wrench seen from the rear, according to an embodiment of the present invention.

Referring to FIG. 8, the rear of the hook 12 is shown. On the lower region 24 of the body 14 of the hook there are three elongated bumps 66, located between the slot 26 and the end 28 of the body. These bumps 66 serve to direct the strap, generally maintaining it in longitudinal alignment with the body of the hook. They may also serve as grips for the handle of the fin key, if the fin key is included as a portion of the hook.

The middle portion 70 of the bend 18 is depressed compared to the outer, side areas 72, 74 of the bend. The middle portion 70 is centered halfway between the sides 76, 78 of the hook and approximately halfway around the bend. More specifically, at least the outer surface of the bend is depressed compared to adjacent side portions of the outer surface of the bend. The depression serves as a locating point for a user's finger when the user is hooking the wetsuit wrench over the edge of the wetsuit or a bootie. By applying force on the depression, the user can center the force along the axis of the hook without looking, helping to insert the hook more efficiently than if the insertion force were to be applied to the hook off-center from its axis. The depression may extend from the middle portion 70 of the bend 18 along the centerline or middle region of the outer surface (62, FIG. 7) of the head, partway or fully to the nose 22. In some embodiments, the depression may be a cylindrically concave contour that extends over most or all of the area of the outer surface of the head. Such a depression may conform better to the surface of the user's body than a flat nose would.

Figure 9:
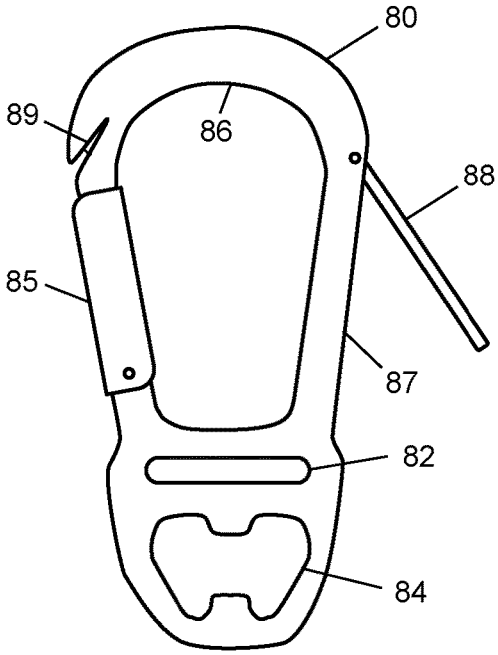
FIG. 9 is a schematic drawing of a carabiner for a wetsuit wrench, according to an embodiment of the present invention.

Referring to FIG. 9, in some embodiments a carabiner 80 is attached to the end of the strap distal from the hook. The carabiner is connected to the strap via a slot 82, the end of the strap being looped through the slot 82 and connected back to itself by stitching or an adjustable buckle. The buckle allows the strap to be adjusted in length. Alternately, or as well, a buckle may be used at the other end of the strap proximal to the hook. There is enough slack in the loop of the strap connected to the carabiner so that it can be moved to one side or the other. This is to reveal a bottle opener 84, which is formed in the frame of the carabiner. By opening the gate 85 of the carabiner, the basket 86 of the carabiner may be looped around the strap to form a large loop in the strap, sufficient to accommodate a foot of the user, for example. The carabiner may also be used to connect to one of the holes 40 in the strap. The spine 87 of the carabiner accommodates a fin key 88, which pivots from a stowed position within or partially within the spine to an in-use position extending outwards from the spine. A safety knife 89 is located in the frame of the carabiner, and may be used to cut loose threads, for example, on a wetsuit or bootie. The weight of the carabiner helps to bring the end of the strap opposite the hook to the floor or ground to better position it for standing on when removing the wetsuit. The weight of the carabiner may be selected to be greater than necessary for the carabiner to function solely as a carabiner in the wetsuit wrench, taking into account the forces that a user would exert on it to remove a wet bootie.

Figure 10:
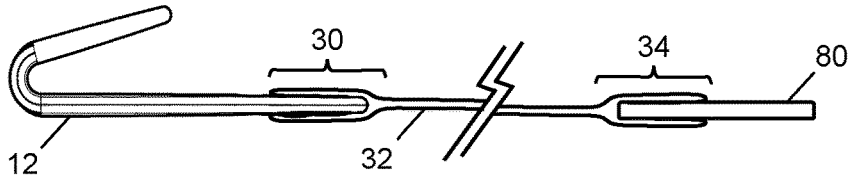
FIG. 10 is a schematic drawing of a wetsuit wrench with a carabiner seen from the side, according to an embodiment of the present invention.

FIG. 10 shows an embodiment of the wetsuit wrench that has a hook 12 connected to one end 30 of a strap 32 and a carabiner 80 connected to the other end 34 of the strap.

The wetsuit wrench is used by first folding over and peeling off a small portion of the wetsuit from the shoulder. Then, the user hooks material in the shoulder of the wetsuit so that pulling the hook would pull the wetsuit in a direction down and/or away from the user's body. Next, the user crouches down and steps on the strap. Then, as the user stands up, the wetsuit is pulled down from over the user's shoulder. The wetsuit, under the force applied by the hook, pulls the fabric of the wetsuit and, therefore allows the user to remove his arm and then upper body from the wetsuit.

This strap is, for example, 1 meter long and is used by being stood on by the user while he is initially crouched down. The hook remains gripped or fastened around the neck opening of the wetsuit by the shoulder while the user crouches down and steps on the middle or far end of the strap (i.e. distal from the hook). Then, the user gradually stands up and the tension created in the strap pulls down the wetsuit from the user's shoulder. The use of the wetsuit wrench results in the user more evenly spreading the stresses over the user's body when removing a wetsuit, and therefore alleviates the risk of injury.

In some cases, the wetsuit wrench is hooked around the top edge or rim of a wetsuit boot or bootie, so that the hook is positioned to pull down on the edge. By looping the strap around an opposite foot and extending this opposite foot and/or by flexing the leg with the bootie to be removed, the wetsuit boot is pulled at least part way from the foot.

Figure 11:
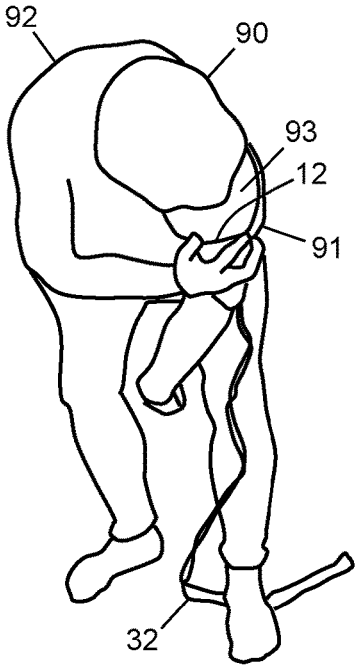
FIG. 11 shows a user initiating removal of a wetsuit from over a shoulder with a wetsuit wrench, according to an embodiment of the present invention.

Referring to FIG. 11, the wetsuit wrench is used by the user 90 first folding over and peeling off a small portion 91 of the wetsuit 92 from the shoulder 93. The user 90 is shown here positioning the hook 12 over the peeled-back shoulder material 91 at the edge of the wetsuit 92, while there is no tension in the strap 32. The user has already crouched down and placed his foot on the strap 32.

Figure 12:
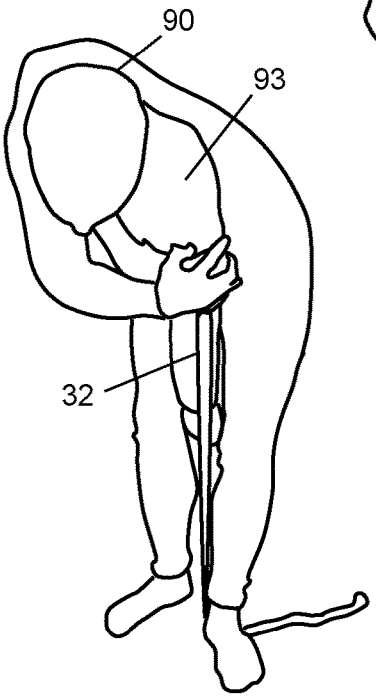
FIG. 12 shows a user having removed a shoulder of a wetsuit with a wetsuit wrench, according to an embodiment of the present invention.

Referring to FIG. 12, next, the user 90 starts to stand up, developing tension in the strap 32. The wetsuit is pulled down from over the user's shoulder 93.

Figure 13:
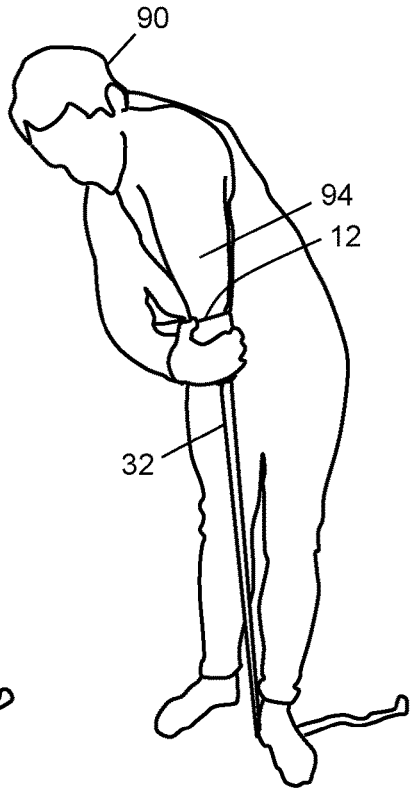
FIG. 13 shows a user about to remove an elbow from a wetsuit with a wetsuit wrench, according to an embodiment of the present invention.

FIG. 13 shows the user 90 almost fully upright and the strap 32 still under tension. The wetsuit reveals the upper arm 94 and is about to be pulled off from over the elbow by the hook 12, as the user stands up further. This then allows the user to remove his upper body from the wetsuit.

Figure 14:
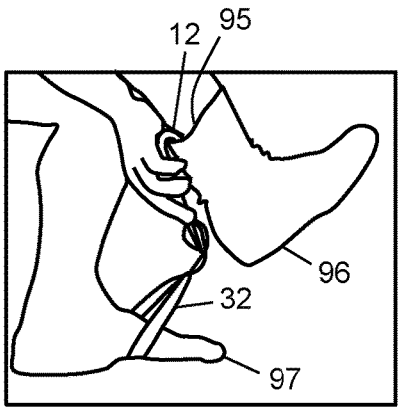
FIG. 14 shows a user about to remove a bootie using a wetsuit wrench, according to an embodiment of the present invention.

FIG. 14 shows the user hooking the hook 12 over the top edge 95 of a bootie 96, on his right foot. The free end of the strap 32 has been fastened in a loop around the user's bare left foot 97.

Figure 15:
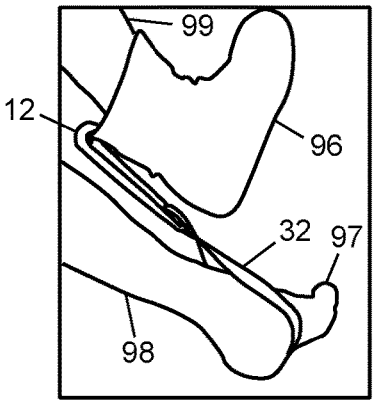
FIG. 15 shows a user having partially pulled down a bootie using a wetsuit wrench, according to an embodiment of the present invention.

FIG. 15 shows the user extending the left foot 97 by extending the left leg 98, while flexing the right leg 99 from which the bootie 96 is to be removed. At this point, tension has been developed in the strap 32 and hook 12.

Figure 16:
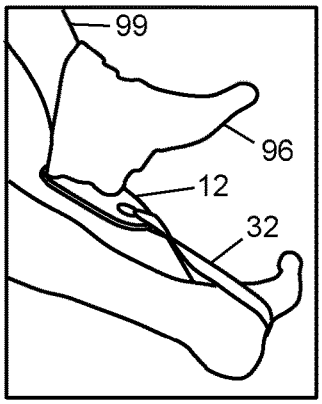
FIG. 16 shows a user about to remove a heel from a bootie using a wetsuit wrench, according to an embodiment of the present invention.

FIG. 16 shows the user having further flexed the right leg 99 from which the bootie 96 is to be removed, still with the strap 32 and hook 12 under tension. The bootie is about to be pulled over the heel, leading to easy removal of the bootie from the foot.

Figure 17:
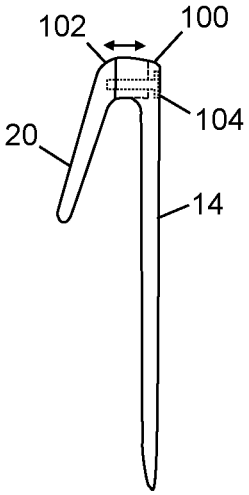
FIG. 17 is a side view of the hook of an adjustable wetsuit wrench, according to an embodiment of the present invention.
Figure 18:
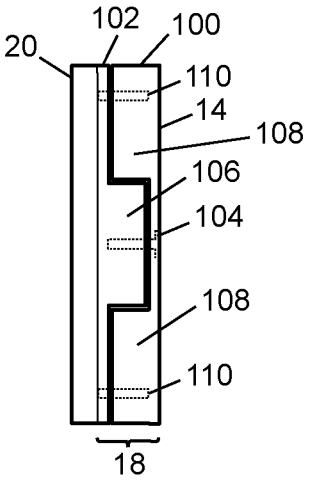
FIG. 18 is a top view of the hook of an adjustable wetsuit wrench in a narrow configuration, according to an embodiment of the present invention.
Figure 19:
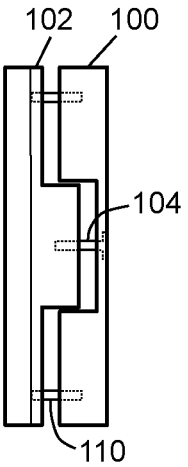
FIG. 19 is a top view of the hook of an adjustable wetsuit wrench in a wide configuration, according to an embodiment of the present invention.

FIGS. 17-19 show the hook of a wetsuit wrench that is adjustable in its gap or capacity, i.e. the distance between the body 14 and the head 20, while maintaining the same relative angle between the head and the body. The hook is divided into a body portion 100 and a head portion 102, and the two portions are connected together by a captive screw 104. The screw 104 is captive in the body portion 100, and as it is turned, the head portion 102 translates away or towards the body portion. The bend of the hook is thickened and/or flattened in order to accommodate the captive screw 104. As viewed from the top, in FIG. 18, the head portion 102 has a tongue 106 that slots into a guide formed by the two sides 108 of the bend 18 at the top of the body portion 100. Translating motion of the head portion 102 relative to the body portion 100 is further guided by pins 110 that are attached to the head portion and slide in and out of corresponding holes present in the body portion 100. FIG. 18 show the adjustable hook in its narrow, or closed configuration. FIG. 19 shows the adjustable hook in a wide or open configuration.

Figure 20:
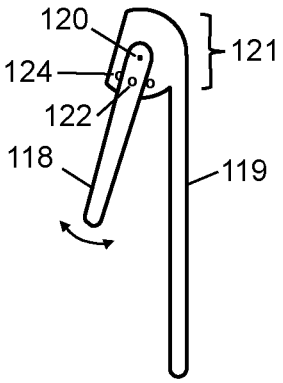
FIG. 20 is a side view of the hook of an adjustable wetsuit wrench, according to an embodiment of the present invention.
Figure 21:
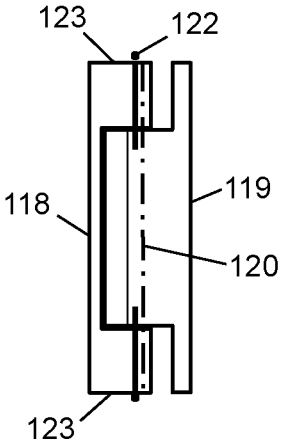
FIG. 21 is a top view of the hook of an adjustable wetsuit wrench, according to an embodiment of the present invention.

FIGS. 20-21 show a hook for a wetsuit wrench that has an adjustable head angle. The head 118 of the hook is pivoted by a pivot 120 to the bend 121 at the top of the body 119. A locking pin 122 is inserted through an arm 123 of the head 20 into one of multiple holes 124 in the head portion that locate the head 118 at a particular angle relative to the body 119. There may be a locking pin 122 on each side of the head.

B. Variations

The hook is the part of the wetsuit wrench that grips, attaches or fastens the fabric of the wetsuit. The hook may include any other fastening or gripping elements that are used to connect to and pull down the wetsuit from the user's body, or pull off a bootie. For example, the hook may be a clamp, or may be replaced with a clamp in some embodiments.

In some embodiments, the wetsuit wrench is made of a robust material that may be, for example, resistant to salty water.

In some embodiments, the wetsuit wrench is made of a rigid, essentially rigid, resilient or slightly flexible material, such that it largely maintains its shape when used.

In some cases, in use, the strap may be attached to an external element such as a tree or a car.

In some embodiments, the wetsuit wrench has two or more hooks or wetsuit fastening elements connected to the strap. For example, one hook may be dimensioned for the shoulder part of the wetsuit and a second hook may be dimensioned for the bootie.

In some embodiments, the hook is a double hook, with two different sizes. For example, the heads of the hooks may project in opposite directions from the body of the hook.

In some embodiments, the length of the strap is fixed. In some embodiments, the length of the strap is adjustable. In some embodiments, the strap is replaceable. In some embodiments, the strap is made of a material that is able to twist. In some cases, the strap is inelastic or substantially inelastic.

In some embodiments, the material and the shape of the hook are chosen in such a way that when the hook is attached to the wetsuit, it will not damage or compromise the integrity of the fabric of the wetsuit.

In some embodiments, the connection between the strap and the hook is fully rotatable to promote more flexibility during the use of the wetsuit wrench. In some embodiments, an additional element such as a guide or a clasp is used to connect the strap to the hook to reinforce the connection between the strap and hook.

In some embodiments, the width of the head may vary differently to terminate in the curved nose compared to the examples described herein. For example, the head may be more triangular in shape, yet still with a curved nose for comfortable insertion between the user's body and the wetsuit.

In some embodiments, the thickness of the head is uniform and does not taper towards the nose. In some embodiments, the radius of curvature of the bend is different to the examples shown herein. In other embodiments, the shape of the bend is different to that shown herein, provided that it accommodates enough folds of the wetsuit for the hook to properly grasp it.

In some embodiments, the plate-like head of the hook may be flat. In other embodiments, the outer surface of the plate-like head may be cylindrically concave, for example like a shoehorn, to conform better to a user's body than a flat head. The plate-like head may be a portion of a cylindrical wall, for example, curving in one direction but not in a direction orthogonal to this.

In some embodiments, both the angle between the head and the body of the hook and the distance between the head and the body are adjustable. In some embodiments, the adjustment of the gap of the hook or the angle of the head relative to the body, or both, may be adjustable due to use of a thermoplastic material for the hook. A hook made of a unitary piece of thermoplastic material may be heated in boiling water, for example, to soften it, or to soften just the bend region of the hook. While soft, the angle of the head and/or the gap of the hook may be reconfigured by manually bending the head and the body of the hook relative to each other. The hook may then be cooled to regain its original rigidity, in its new configuration.

The mechanism for adjusting the hook may include a screw, a grub screw and/or a locking pin for setting the hook to pre-set angles and/or gaps. The mechanism may include a clamp screw, with or without pre-set holes. The adjustment mechanism may be a worm screw, i.e. similar to that of an adjustable spanner, of it may be similar to that of a tongue and groove wrench.

In general, unless otherwise indicated, singular elements may be in the plural and vice versa with no loss of generality.

Features from any of the embodiments may be combined with features from any of the other embodiments to form another embodiment within the scope of the invention.

Embodiments, depending on their configuration, may exhibit all or fewer than all of the advantages described herein. Other advantages not mentioned may be present in one or more of the embodiments.

Throughout the description, specific details have been set forth in order to provide a more thorough understanding of the invention. However, the invention may be practiced without these particulars. In other instances, well known elements have not been shown or described in detail and features have been omitted to avoid unnecessarily obscuring the invention. Accordingly, the specification and drawings are to be regarded in an illustrative, rather than a restrictive, sense.

It will be clear to one having skill in the art that further variations to the specific details disclosed herein can be made, resulting in other embodiments that are within the scope of the invention disclosed.

All parameters, proportions, shapes, dimensions, angles, materials, quantities and configurations described herein are examples only and may be changed depending on the specific embodiment.

Accordingly, the scope of the invention is to be construed in accordance with the substance defined by the claims.

The invention claimed is:

1. A wetsuit wrench comprising:

a hook having a body that is connected at a head end thereof via a bend to a head, wherein the body is plate-like and the head is plate-like; and a strap attached at one end thereof to a lower region of the body distal from the head end;

wherein:

a middle portion of an outer surface of the bend is depressed compared to adjacent side portions of the outer surface of the bend;

the head narrows to terminate in a curved nose;

an edge of the head is radiused; and both an inner surface and an outer surface of the head are smooth.

2. The wetsuit wrench of claim 1, wherein the strap has at least one elongated hole along its length that is long enough to:

accommodate a width of the strap; or allow the hook to pass through.

3. The wetsuit wrench of claim 1, wherein the strap is attached to the hook via a clip or hook-and-loop fastener or via a slot in the lower region of the body.

4. The wetsuit wrench of claim 3, wherein the strap is attached to the slot via a stitched loop in the strap.

5. The wetsuit wrench of claim 1, wherein a portion of the lower region of the body is a fin key that is separable from the remainder of the body.

6. The wetsuit wrench of claim 5, wherein the fin key:

is plugged or screwed into the remainder of the body, or attached to the remainder of the body via a releasable clip; and has a wax-removal edge, a comb or both the wax-removal edge and the comb.

7. The wetsuit wrench of claim 1, comprising a further hook with a different size than the hook.

8. The wetsuit wrench of claim 1, wherein the strap is adjustable in length.

9. The wetsuit wrench of claim 1, wherein the strap is made of a material that is:

(a) twistable;

(b) inelastic;

(c) resistant to salty water; or (d) any combination selected from (a) to (c).

10. The wetsuit wrench of claim 1, wherein the strap is movable between:

a first position that obscures a portion of the lower region of the body; and a second position that reveals said portion of the lower region of the body.

11. The wetsuit wrench of claim 1, wherein the head is concave or cylindrically concave.

12. The wetsuit wrench of claim 1, comprising a carabiner connected to another end of the strap.

13. The wetsuit wrench of claim 12, wherein the carabiner comprises:

(a) a slot via which the other end of the strap is connected;

(b) a fin key pivoted to a spine of the carabiner;

(c) a bottle opener formed in a frame of the carabiner;

(d) a safety knife in the frame of the carabiner; or (e) any combination selected from (a) to (d).

14. The wetsuit wrench of claim 1, wherein a thickness of the head tapers from the bend to the nose.

15. The wetsuit wrench of claim 1, wherein:

(a) an angle between the head and the body is adjustable;

(b) a distance between the head and the body is adjustable; or (c) both (a) and (b).

16. A wetsuit wrench comprising:

a hook having a body that is connected at a head end thereof via a bend to a head, wherein the body is plate-like and the head is plate-like; and a strap attached at one end thereof to a lower region of the body distal from the head end;

wherein:

a portion of the lower region of the body is a fin key that is separable from the remainder of the body;

the head narrows to terminate in a curved nose;

an edge of the head is radiused; and both an inner surface and an outer surface of the head are smooth.

17. The wetsuit wrench of claim 16, wherein the strap has at least one elongated hole along its length that is long enough to:

accommodate a width of the strap; or allow the hook to pass through.

18. The wetsuit wrench of claim 16, wherein the strap is movable between:

a first position that obscures a portion of the lower region of the body; and a second position that reveals said portion of the lower region of the body.

19. The wetsuit wrench of claim 16, wherein the head is concave or cylindrically concave.

20. The wetsuit wrench of claim 16, wherein a thickness of the head tapers from the bend to the nose.

* * * * *